US007385525B2

(12) United States Patent
Ho et al.

(10) Patent No.: US 7,385,525 B2
(45) Date of Patent: Jun. 10, 2008

(54) DYNAMIC TIMING ADJUSTMENT IN AN ELECTRONIC TOLL COLLECTION SYSTEM

(75) Inventors: Thua Van Ho, Mississauga (CA); Roger Tong, Oakville (CA); Wal-Cheung Tang, Mannheim (CA); Daniel Terrier, Toronto (CA); Martin Capper, Milton (CA)

(73) Assignee: Mark IV Industries Corporation, Mississauga, Ontario (CA)

( * ) Notice: Subject to any disclaimer, the term of this patent is extended or adjusted under 35 U.S.C. 154(b) by 328 days.

(21) Appl. No.: 11/176,758

(22) Filed: Jul. 7, 2005

(65) Prior Publication Data

US 2007/0008184 A1 Jan. 11, 2007

(51) Int. Cl.
*G08G 1/00* (2006.01)

(52) U.S. Cl. ..... 340/928; 340/905; 340/936; 455/406; 701/119

(58) Field of Classification Search ..... 340/928, 340/905, 10.1, 933, 941, 825.65, 936; 701/207, 701/24, 117, 119; 342/42, 46, 51; 235/384; 455/406

See application file for complete search history.

(56) References Cited

U.S. PATENT DOCUMENTS

| | | | |
|---|---|---|---|
| 4,104,630 | A | 8/1978 | Chasek |
| 4,303,904 | A | 12/1981 | Chasek |
| 4,870,419 | A | 9/1989 | Baldwin et al. |
| 4,937,581 | A | 6/1990 | Baldwin et al. |
| 5,086,389 | A | 2/1992 | Hassett et al. |
| 5,132,687 | A | 7/1992 | Baldwin et al. |
| 5,144,553 | A | 9/1992 | Hassett et al. |
| 5,164,732 | A | 11/1992 | Brockelsby et al. |
| 5,196,846 | A | 3/1993 | Brockelsby et al. |
| 5,253,162 | A | 10/1993 | Hassett et al. |
| 5,266,947 | A | 11/1993 | Fujiwara et al. |
| 5,289,183 | A | 2/1994 | Hassett et al. |
| 5,310,999 | A | 5/1994 | Claus et al. |
| 5,351,187 | A | 9/1994 | Hassett |
| 5,424,727 | A | 6/1995 | Shieh |

(Continued)

FOREIGN PATENT DOCUMENTS

| | | |
|---|---|---|
| EP | 0 333 679 | 9/1989 |

(Continued)

OTHER PUBLICATIONS

Ching et al., *A Laser Micromachined Multi-Modal Resonating Power Transducer for Wireless Sensing Systems*, Sensors and Actuators A 97-98 (2002) 685-690, http://www.elsevier.com.

(Continued)

*Primary Examiner*—Brent A. Swarthout
(74) *Attorney, Agent, or Firm*—Hanley, Flight & Zimmerman

(57) ABSTRACT

An electronic toll collection system with dynamically adjusted timing for operation of one or more subsystems. The timing is dynamically adjusted based upon the prevailing traffic speed for the roadway. The roadway traffic speed is determined based upon direct measurements of traffic speed by external equipment or based upon a variable correlated with traffic speed. The variable may include the average number of handshakes per transponder over an estimation period. The subsystem may include a vehicle position determination system, an enforcement system, a loop detection system, or other such subsystems.

27 Claims, 7 Drawing Sheets

U.S. PATENT DOCUMENTS

| | | | | |
|---|---|---|---|---|
| 5,425,032 | A | 6/1995 | Shloss et al. | |
| 5,485,520 | A | 1/1996 | Chaum et al. | |
| 5,602,375 | A | 2/1997 | Sunahara et al. | |
| 5,640,156 | A | 6/1997 | Okuda et al. | |
| 5,657,008 | A | 8/1997 | Bantli | |
| 5,675,342 | A | 10/1997 | Sharpe | |
| 5,701,127 | A | 12/1997 | Sharpe | |
| 5,748,106 | A | 5/1998 | Schoenian et al. | |
| 5,751,973 | A | 5/1998 | Hassett | |
| 5,771,021 | A | 6/1998 | Veghte et al. | |
| 5,777,565 | A | 7/1998 | Hayashi et al. | |
| 5,805,082 | A | 9/1998 | Hassett | |
| 5,819,234 | A | 10/1998 | Slavin et al. | |
| 5,831,547 | A | 11/1998 | Ohtsuki et al. | |
| 5,841,866 | A | 11/1998 | Bruwer et al. | |
| 5,850,191 | A | 12/1998 | Yagi et al. | |
| 5,857,152 | A | 1/1999 | Everett | |
| 5,859,415 | A | 1/1999 | Blomqvist et al. | |
| 5,940,006 | A | 8/1999 | MacLellan et al. | |
| 5,963,149 | A | 10/1999 | Nagura et al. | |
| 6,025,799 | A | 2/2000 | Ho et al. | |
| 6,085,805 | A | 7/2000 | Bates | |
| 6,121,880 | A | 9/2000 | Scott et al. | |
| 6,191,705 | B1 | 2/2001 | Oomen et al. | |
| 6,219,613 | B1 * | 4/2001 | Terrier et al. | 701/207 |
| 6,616,034 | B2 | 9/2003 | Wu et al. | |
| 6,661,352 | B2 * | 12/2003 | Tiernay et al. | 340/928 |
| 6,725,014 | B1 | 4/2004 | Voegele | |
| 6,898,753 | B2 | 5/2005 | Bonifas | |
| 2001/0050922 | A1 | 12/2001 | Tiernay et al. | |
| 2006/0071816 | A1 | 4/2006 | Tang et al. | |
| 2006/0082470 | A1 | 4/2006 | Zhu et al. | |

FOREIGN PATENT DOCUMENTS

| | | |
|---|---|---|
| JP | 10-105753 | 4/1998 |
| WO | WO/9933027 | 1/1999 |

OTHER PUBLICATIONS

Finkenzeller, Klaus, *Ch. 3: Fudamental Operating Principles, RFID Handbook: Fundamentals and Applications in Contactless Smart Cards and Identification*, Klaus Finkenzellar, (2003) John Wiley & Sons, Ltd. ISBN 0-470-84402-7.

Sorrells, *Passive RFID Basics*, AN680, Michrochip Technology Inc., (1998) DS00680B.

Woo et al., Dual Mode Electronic Toll Collection Transponder, U.S. Appl. No. 11/409,897, filed Apr. 24, 2006.

Woo et al., Open Road Vehicle Emissions Inspection, U.S. Appl. No. 11/409,741, filed Apr. 24, 2006.

Jeffrey Zhu, System and Method for Secure Mobile Commerce, U.S. Appl. No. 10/912,997, filed Aug. 16, 2004.

Tang et al., Method and System for Obtaining Traffic Information Using Transponders, U.S. Appl. No. 11/284,277, filed Nov. 21, 2005.

Ho et al., Compact Transponder Antenna, U.S. Appl. No. 11/388,737, filed Mar. 24, 2006.

Tang, RF Transponder with Electromechanical Power, U.S. Appl. No. 11/054,520, filed Feb. 9, 2005.

Zhu, U.S. Phase Modulation for Backscatter Transponders, U.S. Appl. No. 11/098,257, filed Apr. 4, 2005.

Tang et al., Method of Enabling Two-State Operation of Electronic Toll Collection System, U.S. Appl. No. 11/437,236, filed May 19, 2006.

* cited by examiner

DYNAMIC TIMING ADJUSTMENT IN AN ELECTRONIC TOLL COLLECTION SYSTEM

FIELD OF THE INVENTION

The present invention relates to an electronic toll collection (ETC) system for conducting transactions with a moving vehicle equipped with a transponder and, in particular, to dynamic adjustment of timing within the ETC system.

BACKGROUND OF THE INVENTION

A vehicle position determination system and method is described in U.S. Pat. No. 6,219,613, which is owned in common with the present application. The vehicle position determination system described therein determines the position of a vehicle in an open-road ETC system by counting the number of interrogation-response communications per antenna. Subject to some weighting, the antenna with the highest count is associated with the position of the transponder-equipped vehicle.

The described system makes its determination following expiry of a sampling time period, which is preset based upon the interrogation cycle time, the roadway speed limit, and various other factors. The sampling time period is set so as to allow the vehicle, under normal conditions, to traverse a significant portion of the coverage zone before the determination is made. If the vehicle is travelling at a slower-than-expected speed and only traverses a small distance into the zone, then the lane assignment may be incorrect and consequent problems with electronic toll transactions or enforcement may result.

In another embodiment, the sampling time period expires when the transponder-equipped vehicle no longer responds to any interrogations—i.e. when it leaves the coverage zone. In many circumstances it is advantageous to make a determination as to lane position for a vehicle before it leaves the coverage zone.

In addition to vehicle position determination, other subsystems of the ETC system may operate on the basis of a preset time period, which is established based upon assumptions regarding vehicle travel time. For example, an in-ground loop detector system for determining the number of axles on a passing vehicle bases its decision on the number of axles detected within a certain time period. The time period takes into account the expected speed of the vehicles. If the vehicles are travelling much slower than expected, then the loop detector system may make an incorrect determination. Similarly, enforcement systems within the ETC system, like overhead cameras, may by triggered to operate when a vehicle passing through the communication zone may be expected to pass through the camera viewing field. The timing for operation of the camera may be partly based upon expected vehicle travel time from a detection point. Vehicles travelling at a slower than expected speed may not come within the field of view when expected.

Therefore, it would be advantageous to provide for an ETC system that addresses, at least in part, some of these issues.

SUMMARY OF THE INVENTION

The present invention provides for an ETC system that uses a dynamically adjusted time period in the operation of one or more of its subsystems. The time period is adjusted based upon the prevailing traffic speed for the roadway. In this manner, the time period is adjusted to account for slower-than-expected traffic that may arise as a result of congestion in the roadway or other factors. The subsystems may, in some embodiments, include vehicle position determination systems, enforcement systems, and loop detector systems.

The system may determine the roadway traffic speed based upon direct measurements of traffic speed by external equipment or based upon a variable correlated with traffic speed. For example, the system may determine the average number of handshakes—i.e. interrogation-response communications—that occur between antennas and a transponder while the transponder is in a coverage zone. The average number of handshakes correlates to the speed of the transponder in traversing the zone. A greater average number of handshakes is indicative of slower traffic. A lower average number of handshakes is indicative of faster traffic. The sampling time period may be set based upon the average number of handshakes per transponder over an estimation period.

In one aspect, the present invention provides a vehicle position determination system for determining a position of a moving vehicle having a transponder in a multi-lane roadway. The system includes two or more antennas having partially overlapped coverage areas, each for transmitting an interrogation signal and receiving a response signal from the transponder. It further includes a reader for receiving the response signals from the antennas. The reader includes a position determination module for determining the position of the moving vehicle based upon the response signals received by the two or more antennas, wherein the determination is made on expiry of a time period. The reader also includes a dynamic timing module for determining a current traffic speed associated with the multi-lane roadway and for setting the time period based upon the current traffic speed.

In another aspect, the present invention provides a method of determining a position of a moving vehicle having a transponder in a multi-lane roadway. The method includes the steps of measuring a current traffic speed associated with the multi-lane roadway and setting a time period based upon the current traffic speed. It also includes steps of exchanging communications with the transponder through two or more antennas having partially overlapped coverage areas, wherein exchanging communications includes transmitting an interrogation signal and receiving a response signal from the transponder, and determining the position of the moving vehicle based upon the response signals received by the two or more antennas, wherein the determination is made on expiry of the time period.

In a further aspect, the present invention provides an electronic toll collection system for conducting transactions with a moving vehicle having a transponder travelling on a roadway. The electronic toll collection system includes at least one subsystem having a trigger component for triggering operation of the subsystem based upon a time period, and a dynamic timing module for determining a current traffic speed associated with the roadway and for setting the time period based upon the current traffic speed.

In yet a further aspect, the present invention provides a method of dynamically adjusting timing within an electronic toll collection system for conducting transactions with a moving vehicle having a transponder travelling in a roadway. The method includes steps of measuring a current traffic speed associated with the roadway, setting a time period based upon the current traffic speed, and triggering operation of a subsystem of the electronic toll collection system upon expiry of the time period.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

Various embodiments of an electronic toll collection (ETC) system and method of operating the same are described below. In the described embodiments, the ETC system includes various subsystems, like vehicle position detection systems, enforcement systems, and/or loop detector systems, that operate on the basis of timing. In one aspect, the timing within the ETC is dynamically adjusted to reflect the prevailing traffic conditions. For example, the timing of operation of one or more of the subsystems may be adjusted to account for the current average roadway speed, as will be described in greater detail below. Prior to such a description, embodiments of a vehicle position determination system are described in which the timing for operation of the system is preset based upon assumptions regarding the vehicle speed in the roadway.

Figure 1:
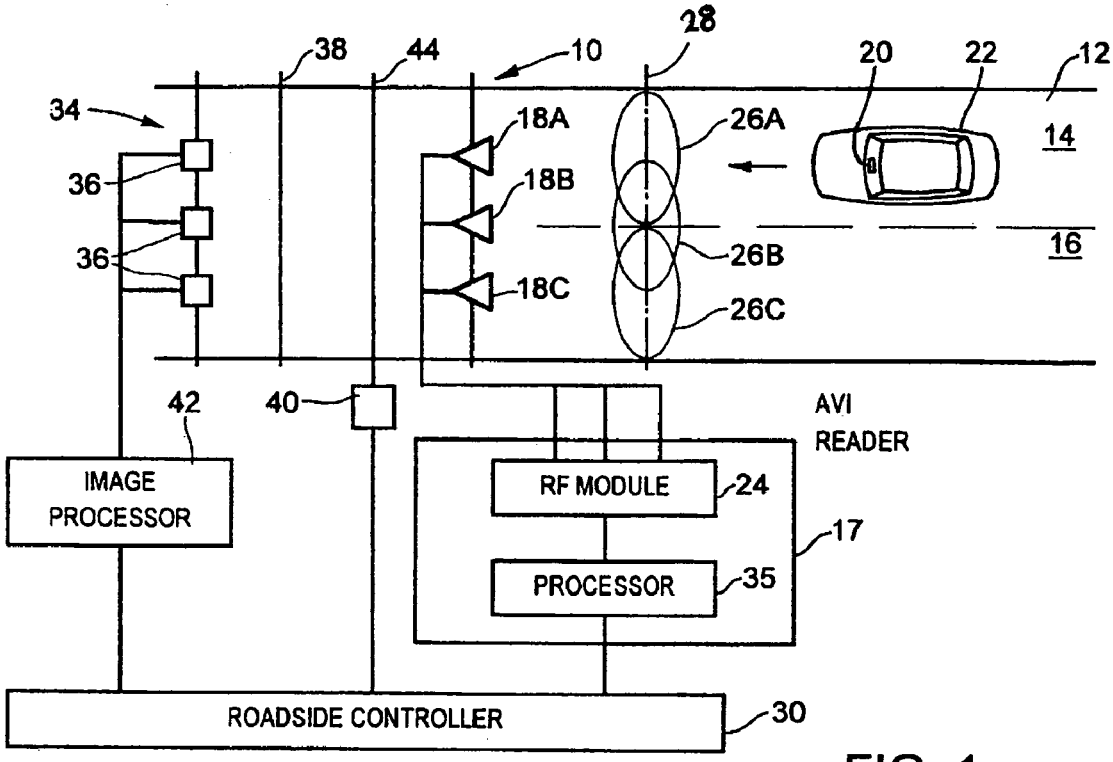
FIG. 1 shows a plan view and block diagram of an embodiment of a vehicle position determination system in a two-lane open-road application.

With reference to FIG. 1, there is shown an embodiment of a vehicle position determination system, illustrated generally by reference numeral 10. As shown in FIG. 1, the vehicle position determination system 10 is applied to a roadway 12 having first and second adjacent lanes 14 and 16. The roadway 12 may be a two lane access roadway leading towards or away from a toll highway. The vehicle position determination system 10 includes three antennas 18A, 18B and 18C, each of which is connected to signal processing means, namely an Automatic Vehicle Identification ("AVI") reader 17. The AVI reader 17 processes signals that are sent and received by the antennas 18A, 18B and 18C, and includes a processor 35 and a Radio Frequency (RF) module 24.

The RF module 24 is configured to modulate signals from the processor 35 for transmission as RF signals over the antennas 18A, 18B and 18C, and to de-modulate RF signals received by the antennas 18A, 18B and 18C into a form suitable for use by the processor 35. In this regard, the AVI reader 17 employs hardware and signal processing techniques that are well known in the art. The processor 35 includes a programmable processing unit, volatile and non-volatile memory storing instructions and data necessary for the operation of the processor 35, and communications interfaces to permit the processor 35 to communicate with RF module 24 and a roadside controller 30.

The antennas 18A, 18B and 18C, and AVI reader 17 function to trigger or activate a transponder 20 (shown in the windshield of car 22), to record transponder specific information, and to acknowledge to the transponder 20 that a validated exchange has taken place. The antennas 18A, 18B and 18C are directional transmit and receive antennas which, in the illustrated preferred embodiment, have an orientation such that each antenna 18A, 18B and 18C can only receive signals transmitted from a transponder when the transponder is located within a roughly elliptical coverage zone associated with the antenna. The antennas 18A, 18B and 18C are located above the roadway 12 and arranged such that the antenna 18A has a coverage zone 26A that extends across the first lane 14, antenna 18B has a coverage zone which extends from approximately the center of lane 14 to the center of lane 16, and the antenna 18C has a coverage zone 26C which extends across the entire width of the second lane 16. Each of the coverage zones 26A, 26B and 26C are of an approximately elliptical shape and cover an approximately similar sized area. Furthermore, the coverage zones 26A, 26B and 26C are aligned side-by-side along an axis 28 that is orthogonal to the travel path along roadway 12. As is apparent from FIG. 1, the coverage zone 26A provides complete coverage of the first lane 14, and the coverage zone 26C provides complete coverage of the second lane 16. The coverage zone 26B overlaps both of the coverage zones 26A and 26C.

It will be understood that although the coverage zones 26A, 26B and 26C are illustrated as having elliptical shapes, in reality the actual shapes of the coverage zones 26A, 26B and 26C will typically not be perfectly elliptical, but will have a shape that is dependent upon a number of factors, including RF reflections or interference caused by nearby structures, the antenna pattern and mounting orientation. Prior to operation of the vehicle position determination system 10, the actual approximate coverage shape and size of each of the coverage zones are determined through well known mapping or approximation techniques, and stored by the processor 35 of the vehicle position determination system 10 such that the size, shape and location of each of the coverage areas 26A, 26B and 26C are generally known and predetermined by the system.

The AVI reader 17 is connected to a roadside controller 30. In open road toll systems, the vehicle position determination system 10 may be used in conjunction with a vehicle imaging system, which is indicated generally by reference numeral 34. The imaging system 34 includes an image processor 42 to which is connected a number of cameras 36 arranged to cover the width of the roadway for capturing images of vehicles as they cross a camera line 38 that extends orthogonally across the roadway 12. The image processor 42 is connected to roadside controller 30, and operation of the cameras 36 may be synchronized by the roadside controller 30 in conjunction with a vehicle detector 40. The vehicle detector 40, which is connected to the roadside controller 30, detects when a vehicle has crossed a vehicle detection line 44 that extends orthogonally across the roadway 12, which is located before the camera line 38 (relative to the direction of travel). The output of the vehicle detector 40 is used by the roadside controller 30 to control the operation of the cameras 36. The vehicle detector 40 can take a number of different configurations that are well known in the art, for example it can be a device which detects the obstruction of light by an object.

Figure 3:
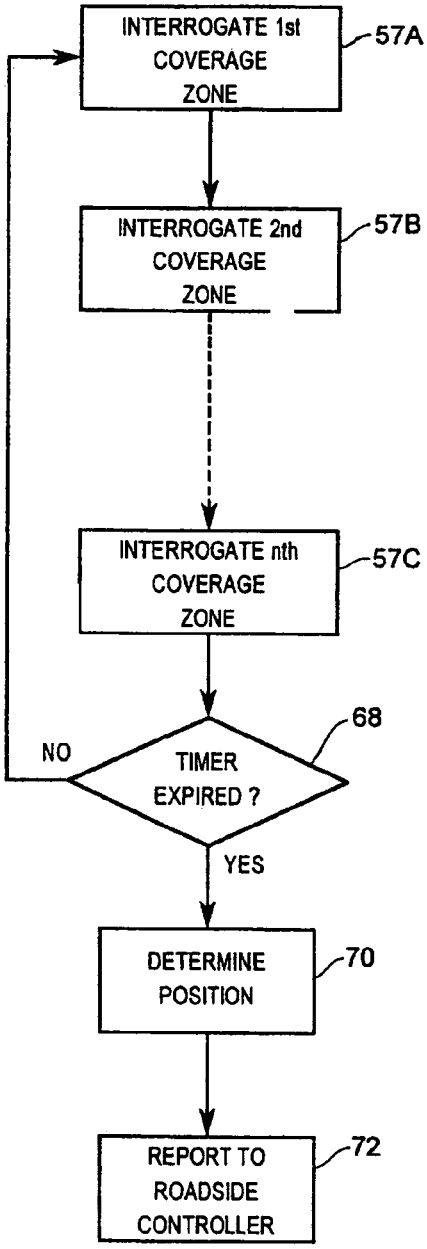
FIG. 3 shows, in flow chart form, an embodiment of a method for determining vehicle position.

With reference to FIG. 1 and the flow charts of FIGS. 3 and 4, the operation of a vehicle position determination system will now be described. The AVI reader 17 is configured to repeatedly perform periodic interrogation cycles. In particular, with reference to FIG. 3, the AVI reader 17 is programmed so that during each interrogation cycle all of the first to "nth" coverage zones of the vehicle position detection system are sequentially interrogated in time division multiplex manner (steps 57A, 57B to 57C). In the case of the vehicle position detection system 10 shown in FIG. 1, only three coverage zones 26A, 26B and 26C need be interrogated, and accordingly for such system, n=3.

Figure 4:
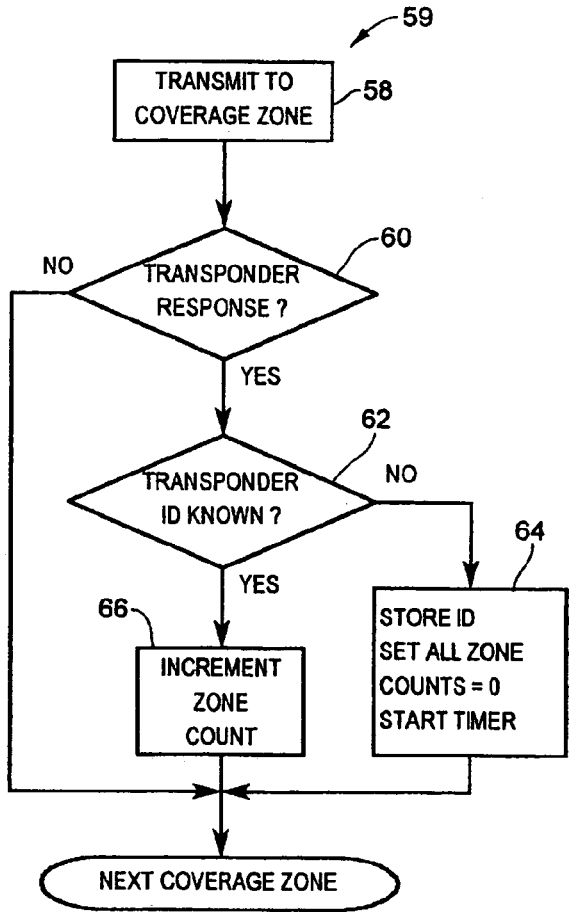
FIG. 4 shows, in flowchart form, an embodiment of a method for interrogating a coverage zone.

FIG. 4 is a flow chart of a coverage zone interrogation routine 59 that is performed as part of each of the coverage zone interrogation steps 57A, 57B to 57C. When interrogating a coverage zone, the AVI reader 17 causes the antenna associated with the coverage zone to transmit an interrogation signal to the coverage zone (step 58), and then checks to see if a response data signal is received by the associated antenna from a transponder (step 60). Thus, in the case of the first coverage zone, the AVI system 17 causes antenna 18A to transmit an interrogation signal to coverage zone 26A, and checks to see if antenna 18A subsequently receives a response signal transmitted by a transponder.

If no transponder is located within the interrogated coverage zone then no transponder response will be received by the antenna associated with that coverage zone and the interrogation routine 59 will end in respect of that coverage zone and commence in respect of the next coverage zone. If, however, any transponders are located in the interrogated coverage zone, they will each respond to the interrogation signal with a response data signal, which includes a unique transponder ID code for each transponder. The AVI processor 35 then determines, for each transponder that responded, if the transponder ID code is known (step 62).

An unknown transponder ID code signifies that a previously untracked transponder has entered the coverage zones. For each previously unknown transponder, a tracking initialization step 64 is performed in which the transponder ID code is stored by AVI reader 17 (thereby making the transponder ID a known ID during subsequent interrogations). For each transponder it tracks, the AVI reader 17 maintains a zone counter for each of the coverage zones to count the number of responses received from the transponder in each of the separate coverage zones during a sampling time period. Accordingly, as part of the tracking initialization step 64, the AVI reader sets all the zone counters for the transponder to zero, and starts a transponder specific timer to count down a sampling time period for the transponder.

A known transponder ID signifies that the transponder is already being tracked by the AVI reader 17 (ie. that transponder has already sent a data response signal to at least one of the system antennas 18A, 18B or 18C). For each transponder which responds with a known ID, the zone counter associated with the transponder for the coverage zone is incremented (step 66).

As noted above, the interrogation routine 59 is performed for each of the first to nth coverage zones during each interrogation cycle. At the end of each interrogation cycle, the AVI processor 35 checks to see if the timers for any of the transponders that are currently being tracked have expired (step 68). For any transponders for which the corresponding timers have expired (i.e. the sampling time period has run out), the AVI processor determines, based on the coverage zone counts for each transponder, a probable lateral position on the roadway of the vehicle carrying the transponder (step 70), and communicates a report to the roadside controller 30 (step 77).

Thus, each time a transponder enters one of the three coverage zones 26A, 26B or 26C, the AVI reader 17 establishes communication with the transponder 20 and counts the number of transponder response data signals received by each of the antennas 18A, 18B and 18C from the coverage zones 26A, 26B and 26C, respectively, during the sampling time period. By comparing the total counts for each coverage zone, a probable vehicle position can be determined. The system 10 is able to track multiple transponders simultaneously through the coverage zones as it counts down a sampling time period and tracks zone counts for each unique transponder ID.

In one embodiment, the sampling time period is of a predetermined duration that is generally sufficient to allow an adequate number of interrogation cycles to occur for the AVI reader 17 to determine, with acceptable accuracy, the location of transponder and vehicle 22. The predetermined time period is application specific (depending on many factors, for example how quick the positional data is needed by down road equipment such as imaging system 34, and the maximum speed of vehicles on the roadway). Preferably, the sampling time period should be set such that in the majority of cases, the vehicle will have at least passed axis 28 when the time period expires.

In another possible embodiment, the sampling time period can be set to vary according to the speed of the particular vehicle being tracked. For example, the AVI reader 17 could be configured to end the sampling time in the event that none of the antennas 18A, 18B or 18C receives a data response signal from a transponder during one (or more) interrogation cycles (the absence of a response indicating the vehicle has already passed through the coverage zone).

In yet another embodiment, the sampling time period is determined based upon the speed of traffic in the roadway 12. The speed of traffic in the roadway 12 may vary from the speed of a particular vehicle and it may serve as a general proxy for how quickly the average vehicle will traverse the coverage zones 26A, 26B, and 26C. This embodiment, and various methods of dynamically determining the speed of traffic and setting the sampling time period, are outlined in greater detail below in connection with FIGS. 6 to 8.

As noted above, the AVI reader 17 determines probable vehicle location by comparing the number of periodic response signals received from a specific transponder for each antenna 18A, 18B and 18C during the sampling time period. The total count information can be processed to provide different levels of locational resolution. For example, in the case of similar elliptical coverage zones 26A, 26B and 26C, the AVI reader can be configured to classify the transponder as being: (1) in lane 14 if the total count is highest for antenna 18A; (2) in lane 16 if the total count is highest for antenna 18C; or (3) in the center of roadway 12, if the count from the antenna 18B is the highest. In the event of a tie, the AVI reader can be configured to arbitrarily choose one of the two possible positions.

Figure 5:
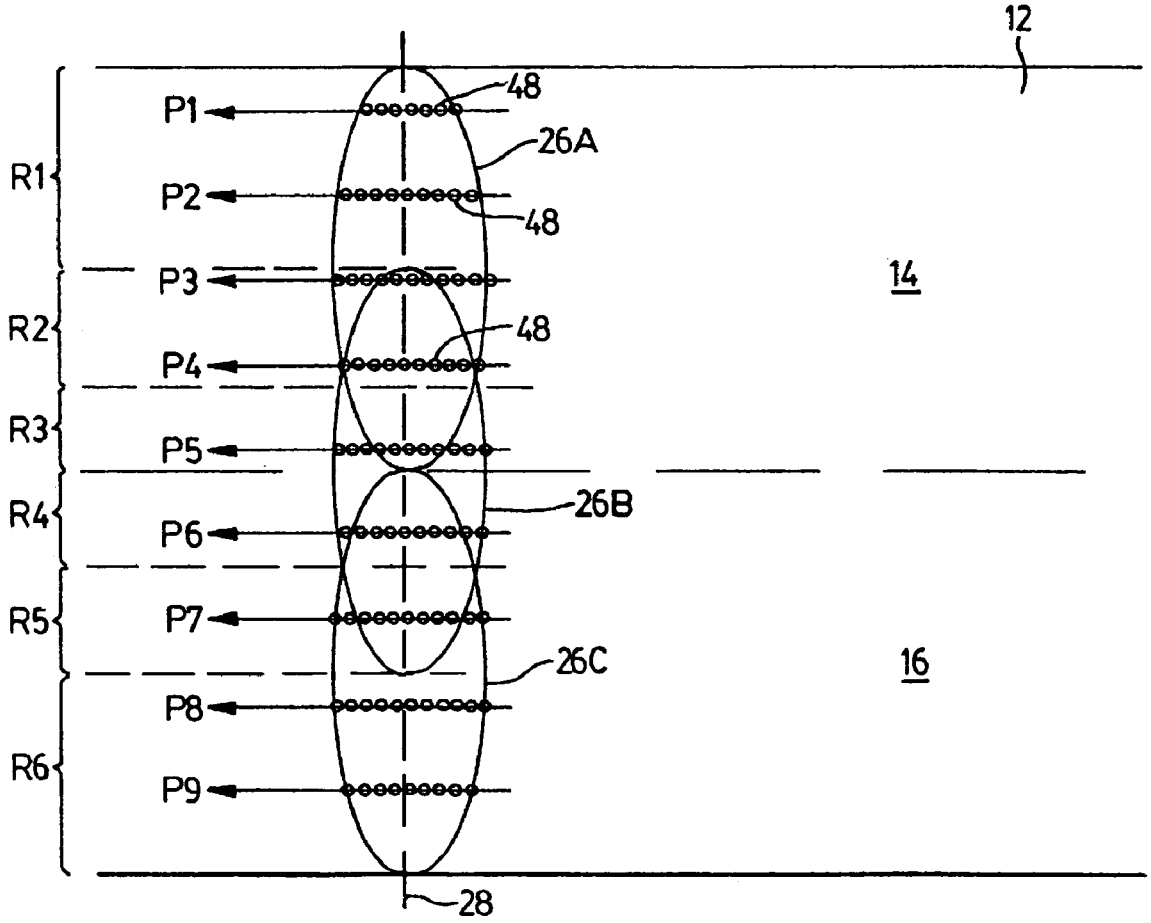
FIG. 5 shows a partial plan view of example transponder paths through coverage zones of the vehicle position determination system of FIG. 1.

Interpolation analysis, involving comparing the ratios of total counts from the different coverage areas to predetermined thresholds, could be used to provide a higher level of resolution. For example, as shown in FIG. 5, the roadway 12 can be divided into ranges R1-R6 across its width, with position being determined according to the following exemplary interpolation algorithm:

```
IF COUNT A>0 AND COUNT B=0 THEN LOCATION=R1 ELSE . . .
IF COUNT A>0 AND COUNT A/COUNT B>1 THEN LOCATION=R2 ELSE
IF COUNT A>0 AND COUNT A/COUNT B.Itoreq.1 THEN LOCATION=R3
ELSE
IF COUNT A=0 AND COUNT B>0 AND COUNT C=0 THEN
LOCATION=R3 ELSE
IF COUNT B>0 AND COUNT B/COUNT C≧1 THEN LOCATION=R4 ELSE
IF COUNT B>0 AND COUNT B/COUNT C<1 THEN LOCATION=RS
ELSE
LOCATION=R6
where COUNT A, COUNT B and COUNT C are the total number of
successful communications for the antennas 18A, 18B and 18C,
respectively, during the sampling time period.
```

As will be noted from the above algorithm, the AVI reader 17 is configured to arbitrarily select a suitable position when the transponder path follows directly along a line where two ranges meet (for example, following the juncture line between range R2 and R3 will result in a location determination of R3 in accordance with the above algorithm).

During the sampling time period, information will preferably be exchanged between the transponder 20 and the determination 10 system. As noted above, the data signal sent out by transponder 20 will include a unique transponder identification code so that the AVI reader 17 can associate the positional data that it generates with a specific transponder identity. Furthermore, at some time during the sampling time, the AVI reader 17 will preferably cause one of the antennas to send a "write" signal to the transponder to provide the transponder with whatever data is required by the toll system. Thus, it will be appreciated that the informational content of the interrogation signals and data signals can vary during the sample time period, however the actual content of such signals does not affect the response data signal count logs kept by the determination system 10.

Once the AVI reader 17 has made a determination of the probable vehicle position, it creates an electronic report that includes the probable position, transponder identification data, and any other information specific to the AVI system, and provides the electronic report to the roadside controller 30. It also erases the transponder ID from its list of "known" transponder IDs as it is no longer tracking the transponder.

The electronic reports that are generated by the vehicle position determination system 10 can be used by the vehicle imaging system 34 to provide improved accuracy in determining between transponder equipped and unequipped vehicles. The presence or absence of an electronic report, together with reliable location information, can be used to qualify the operation of the imaging system 34 so that unnecessary images can be eliminated altogether, or to improve the accuracy of processing images that are taken.

It will be appreciated that in order to provide optimum accuracy for a toll collection system such as that shown in FIG. 1, it is desirable to align the generation of an electronic report for a vehicle with the detection of the vehicle by detector 40 as closely as possible in order to avoid intermediate changes in the vehicle position. Thus coverage zones 26A, 26B and 26C are preferably located as close as possible to detection line 44 as the system constraints allow. The fact that the coverage zones 26A, 26B and 26C are aligned co-linearly across the roadway allows a shorter total sampling period than if they were offset (relative to the direction of traffic) thereby increasing accuracy.

An exemplary implementation of the vehicle detection system 10 and sample position determinations will now be described. In the exemplary implementation of vehicle detection system 10 in an open road system, each interrogation cycle has a duration of 10 mSec., and the sample time period can be set to 100 mSec, during which time a vehicle will typically traverse about 9 feet at 60 mph. Such a configuration allows the AVI reader 17 to count the number of successful responses for 15 interrogation signals sent out by each of the antennas 18A, 18B and 18C, and determine a probable vehicle location based on such counts. In an exemplary implementation, the vehicle detection line 44 is located further down road than the maximum vehicle travel during the 100 mSecs. For a roadway 12 having typical 12 foot lanes, the coverage zones 26A, 26B and 26C can each have an approximate width across their major axis of 14 feet, and an approximate length across their minor axis (i.e. in the direction of travel) of about ten feet.

FIG. 5 illustrates a number of possible transponder paths P1-P9 through the coverage zones 26A, 26B and 26C of the exemplary implementation. Each of the circles 48 that are superimposed on the path lines P1-P9 represent response data signals sent from the transponder 20. In particular, each circle that is exclusive to a single coverage zone indicates a response data signal received by the antenna associated with such coverage zone, and each circle in an area where two coverage zones overlap indicates response data signals received by both of the antennas that cover the overlapped area. Table 1 shows, for each of the illustrated transponder paths P1-P9, the resulting total response data signals received by each antenna 18A, 18B and 18C, a vehicle position determination using an average majority (i.e. highest total) method, and a vehicle position determination (ranges R1-R6) using the exemplary interpolation algorithm set out above.

TABLE I

Exemplary Interrogation Results

| | Interrogation Counts | | | Averaged | Averaged |
|---|---|---|---|---|---|
| Path | 18A | 18B | 18C | Majority | Interpolation |
| P1 | 7 | 0 | 0 | Lane 14 | R1 |
| P2 | 10 | 0 | 0 | Lane 14 | R1 |
| P3 | 11 | 3 | 0 | Lane 14 | R2 |
| P4 | 10 | 9 | 0 | Lane 14 | R2 |
| P5 | 5 | 11 | 0 | Centre | R3 |

TABLE I-continued

| Exemplary Interrogation Results | | | | | |
|---|---|---|---|---|---|
| Interrogation Counts | | | | Averaged | Averaged |
| Path | 18A | 18B | 18C | Majority | Interpolation |
| P6 | 0 | 10 | 8 | Centre | R3 |
| P7 | 0 | 7 | 11 | Lane 16 | R4 |
| P8 | 0 | 0 | 11 | Lane 16 | R5 |
| P9 | 0 | 0 | 9 | Lane 16 | R5 |

It will be appreciated that the vehicle position detection system may take many different configurations depending upon its particular application. For example, more than three overlapping coverage zones could be used, particularly where it was desirable to cover more than two lanes of a roadway. Furthermore, in situations where lane changes are not permitted due to barriers between traffic lanes, two overlapping coverage zones would be sufficient for two travel lanes.

Figure 2:
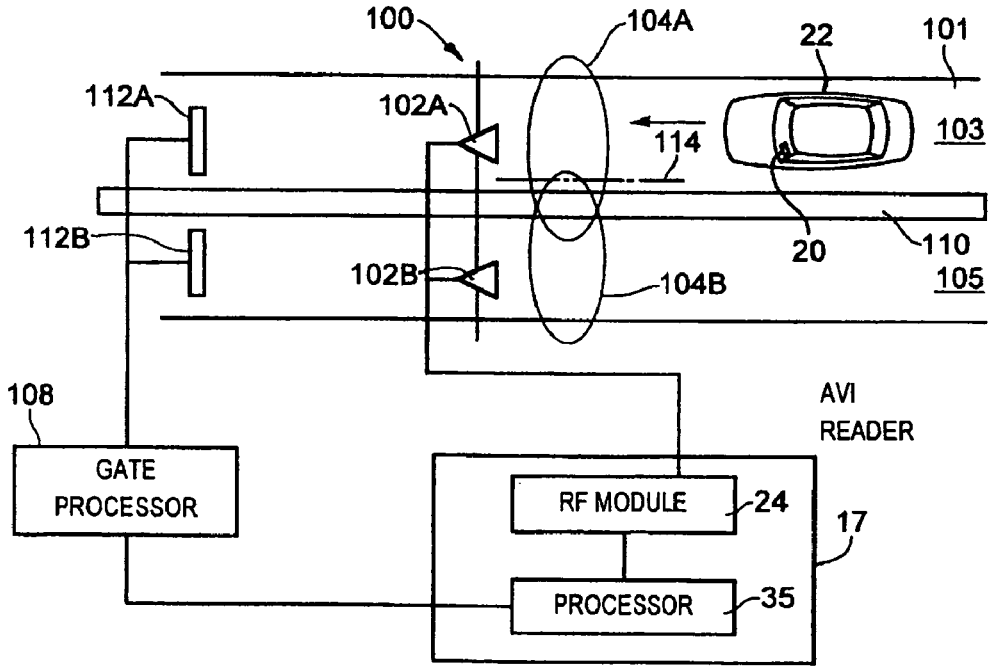
FIG. 2 shows a plan view and block diagram of an embodiment of a vehicle position determination system in a separate lane closed-road application.

In this regard, FIG. 2 illustrates a further embodiment of a vehicle position detection system 100. The vehicle position detection system 100 is the same as vehicle position detection system 10 described above except as noted below. Detection system 100 is used in a closed lane toll system wherein two adjacent exit lanes 103, 105 of roadway 101 are separated by a physical barrier 110. The presence of physical barrier 110 ensures that vehicles will not straddle the centre line between lanes 103 and 105, and accordingly only two coverage zones 104A and 104B, covered by antennas 102A and 102B, respectively, are required to provide shoulder to shoulder coverage. The antennas 102A and 102B are each connected to AVI reader 17, which determines which of lanes 103 or 105 transponder equipped vehicle 22 is in by determining which of the antennas 102A or 102B has the highest number of successful communications with the vehicle transponder 20 during the sampling period. For example, as shown in FIG. 2, the transponder 20 follows a path indicated by line 114, through both coverage zones 104A and 104B. The AVI reader 17 will conclude that the vehicle 22 is located in lane 103 as the total number of successful communications for antenna 102A will be greater than that for antenna 102B. The AVI reader 17 provides an electronic position report to a gate processor 108 which selectively raises physical barrier 12A or 112B depending upon the position determined by AVI reader 17.

The "averaged majority" and "averaged interpolation" algorithms suggested above are suitable for determining position when the coverage zones each have a generally uniform size and shape. The actual algorithm or method used to determine a position will depend upon a number of factors including the specific application of the vehicle position detection system, the shape and relative sizes of the coverage zones, and the degree of resolution needed for such application. For irregularly shaped coverage zones, the various different permutations and combinations of possible coverage zone counts, or ratios of coverage zone counts, for different possible vehicle paths through the coverage zones can be predetermined and provided to the processor 35 as a locally stored look-up table. As part of the position determination step 70, the processor 35 can compare the coverage zone counts, or ratios of coverage zone counts, as the case may be, to the look-up table to determine a vehicle position.

Although each of the antennas discussed above have been described as both transmitting and receiving, it is also possible that a single transmitting antenna could be used to transmit signals to all coverage zones, with each coverage zone being covered by a separate receive antenna.

As suggested above, although elliptical coverage areas are disclosed as a preferred embodiment, other shapes could also be used for the coverage areas, so long as each coverage area had an known size and shape and the length of each coverage area varied in a known manner along the width of the coverage area, at least at the places where the coverage zones overlapped.

Referring again to FIG. 1, it will be appreciated that the above-described embodiments involve a predetermined or preset sampling time period during which the transponder is interrogated and response data signals received by the various antennas 18A, 18B, and 18C, are tracked. For example, the sampling time period may be set to 100 msec on the basis that by that point in time a vehicle travelling at the speed limit on the roadway (in an open road embodiment) will have progressed at least a minimum distance into the coverage zone 26A, 26B, or 26C, such that a sufficient number of interrogation cycles have occurred that a proper determination may be made as to lane position for the vehicle. In particular, the vehicle might be expected to have passed the axis 28 by the time the sampling time period expires. It will be appreciated that this presumes that the vehicle is travelling at a certain speed. In the event of a traffic jam, vehicles in the roadway may be travelling very slowly, meaning that a vehicle will have progressed only a short distance into one of the coverage zones 26A, 26B, or 26C at the point when the system 10 attempts to make a lane position determination. This may result in inaccurate lane assignments and unsuccessful electronic toll collection transactions.

In many embodiments, the ETC transaction occurs after the lane position is determined. The position of the vehicle is identified because that may then determines the appropriate antenna 18A, 18B, and 18C for reporting a transaction. The position of the vehicle may also be used for enforcement in distinguishing vehicles with transponders from vehicles without transponders.

In some cases, the ETC transaction occurs by having the reader 17 forward transponder information to an external system, like the roadside controller 30, wherein the transaction is processed. In other cases, such as where the transponder 20 stores a cash value within its memory, the reader 17 sends a programming signal to the transponder 20 instructing it to debit its stored value by the transaction charges. In such embodiments, it may be necessary for the lane position be determined prior to the vehicle exiting the coverage zones 26A, 26B, or 26C so that the appropriate antenna may send a programming signal to the transponder. A sampling time that is too long may result in lane assignments being made after a vehicle has left the coverage zones. A sampling time that is too short may result in, lane assignment being made before a slow moving vehicle has progressed a significant distance into the coverage zones. This is especially damaging in a system wherein the lane assignment is based upon received response signal strength comparisons between antennas instead of response signal counts.

Accordingly, in some embodiments the sampling time period may be established dynamically based upon the prevailing traffic speed of the roadway. If the roadway is congested, such that the speed of traffic has slowed to 5 or 10 mph, then the sampling time period may be automatically adjusted to allow for more time to elapse before a lane assignment is made. If the traffic speed then increases, the sampling time period may be re-adjusted to reflect the faster traffic.

The speed of traffic on the roadway is not vehicle-specific. It may be an average speed of vehicles in one or more laneways or across all of the laneways. It may alternatively be a mean speed or a weighted average speed.

Information regarding the speed of traffic in the roadway may be input to the vehicle position determination system 10 from external sources. For example, the vehicle position determination system 10 may receive roadway traffic speed data from an external system that measures the traffic speed. Such an external system may rely upon roadway sensors, radar guns, laser guns, or other mechanisms for determining the speed of vehicles and calculating an overall traffic speed for the roadway. In another embodiment, the vehicle traffic speed may be provided by a third-party entity, such as a municipal or regional traffic authority.

In yet another embodiment, the roadway traffic speed may be determined by the vehicle position determination system 10. The system 10 may analyze the interrogation cycles and handshakes (i.e. interrogation and response communications) to determine the roadway speed. Based upon the average number of handshakes per transponder, the system 10 may determine the average time spent in the coverage zones 26A, 26B, and 26C, and/or the average traffic speed. In other words, the sampling time period may be dynamically adjusted based upon an assessment of the average number of handshakes per transponder, or the average number of handshakes in a test period per antenna.

Figure 6:
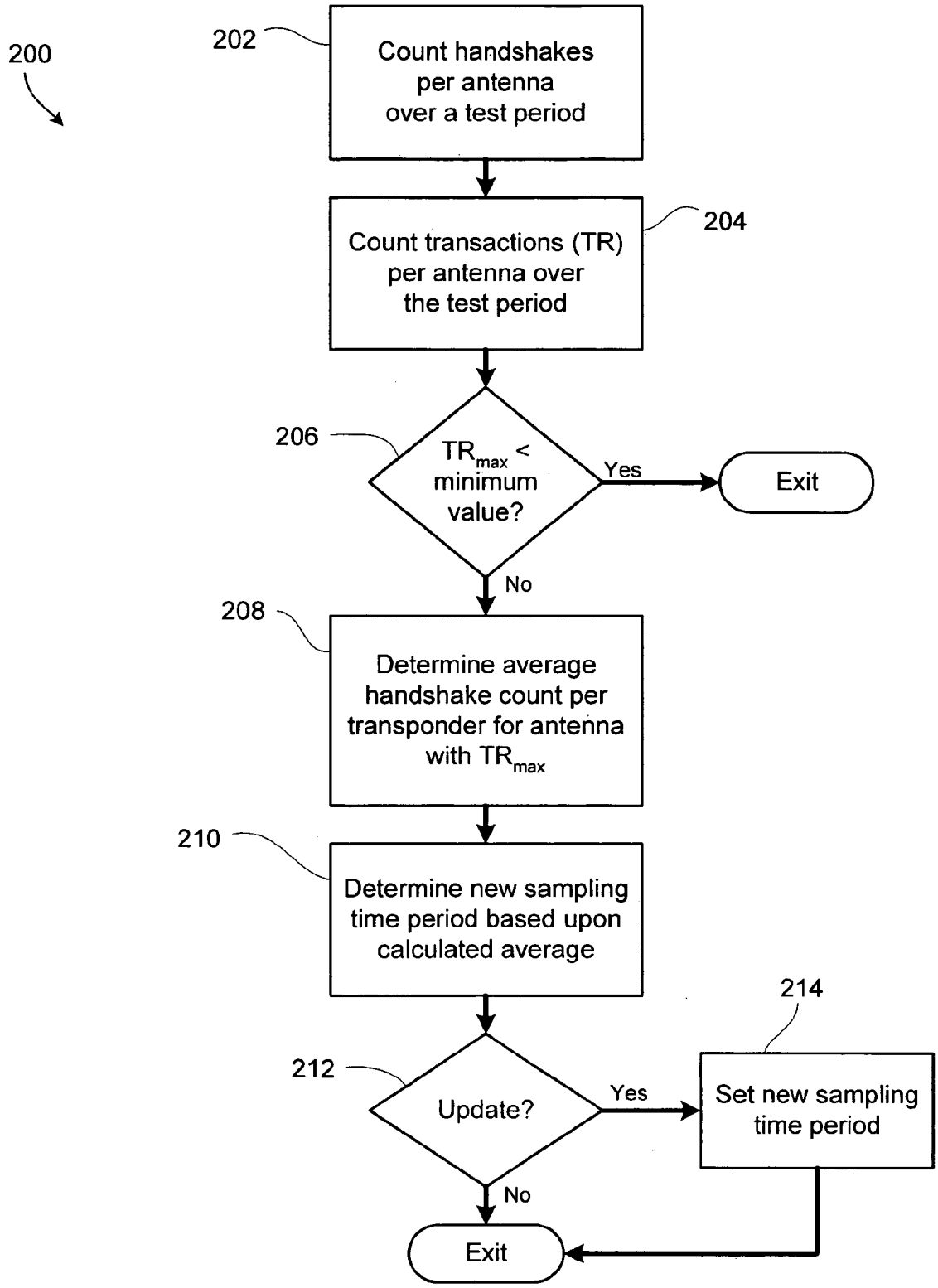
FIG. 6 shows, in flowchart form, a method of selecting a new sampling time period for use in a vehicle position determination system.

Reference is made to FIG. 6, which shows, in flowchart form, an embodiment of a method 200 of dynamically setting a sampling time period for a lane position determination system. The method 200 begins with steps 202 and 204, wherein handshakes (i.e. interrogation and response communications between readers and transponders) and transactions are counted over a test period. The test period may be any suitable length depending upon the processing power, roadway characteristics, or other factors. In one embodiment, the test period is about 10 seconds.

Figure 7:
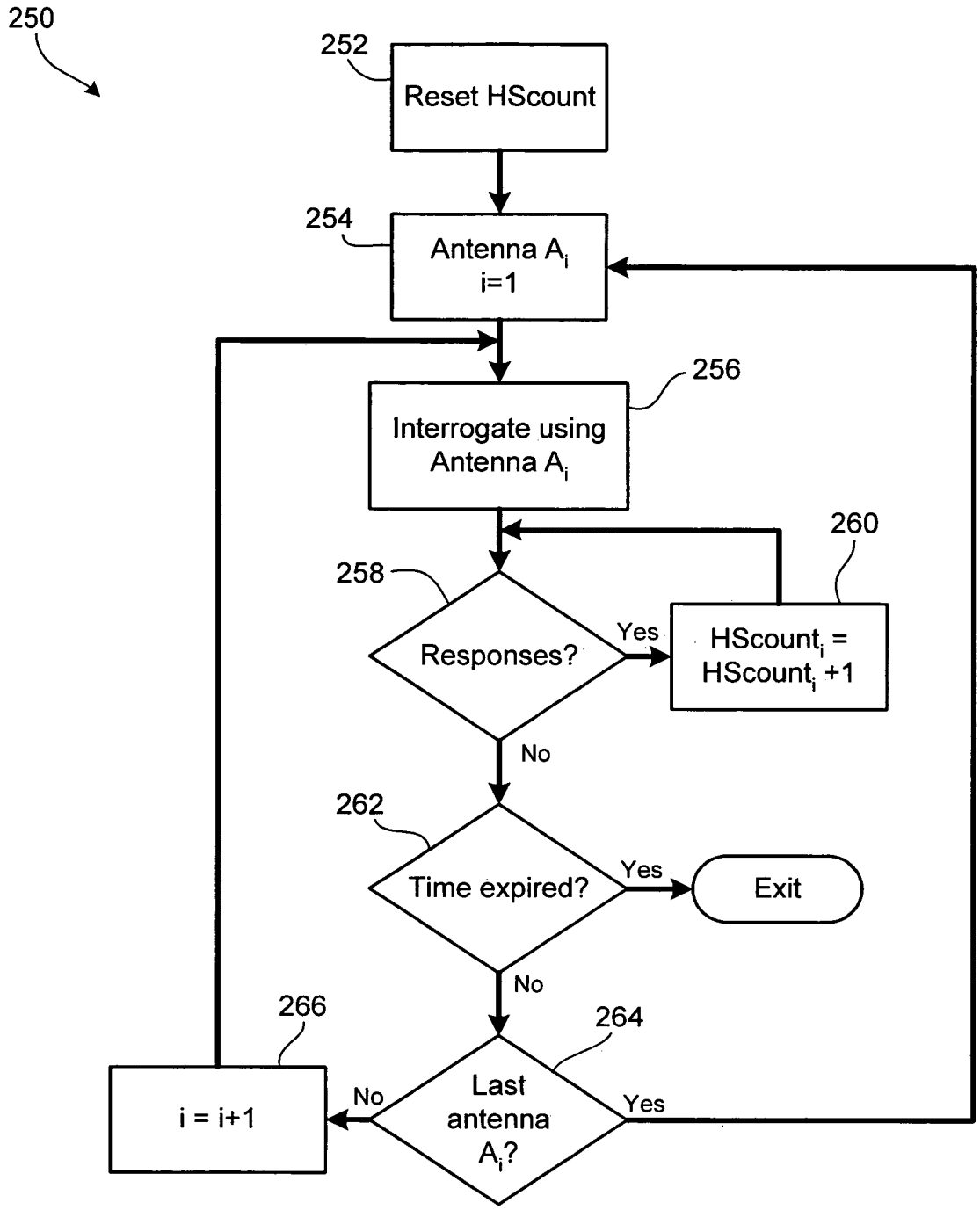
FIG. 7 shows, in flowchart form, a method of counting handshakes for use in the method illustrated in FIG. 6.

Over the course of the test period, handshakes are counted for each antenna or channel. In one embodiment, the reader maintains a cumulative counter associated with each antenna and increments the counter for each handshake conducted through the antenna. This embodiment is illustrated in FIG. 7, which shows in flowchart form a method 250 of cumulatively counting handshakes per antenna. The method 250 begins in step 252 with an initialization of the handshake count for all antennas to zero. Then in step 254, an antenna variable i is set to begin at 1, referring to the first antenna.

Steps 256 to 266 are repeated for each antenna from the first to the last antenna. Then, once the last antenna is reached in step 266, the method 250 cycles back to step 254 to start again with the first antenna. The method 250 continues for the duration of the test period.

In step 256, an interrogation signal is broadcast by antenna $A_i$ into its coverage zone. If responses are noted in step 258 then in step 260 the handshake count ($HScount_i$) for the antenna is incremented for each response signal from a transponder in the coverage zone. If no further response signals are received, then in step 262 the reader considers whether the test period has expired. If so, then the method 250 returns to the method 200 shown in FIG. 6. Otherwise, the method 250 continues to step 266.

Referring again to FIG. 6, it will be appreciated that steps 202 and 204 occur simultaneously over the test period. Following the expiry of the test period, in step 206 the reader determines whether any of the antennas have conducted more than the minimum number of transactions. If none of the antennas meet the minimum number of transactions, then it may be indicative of a roadway with too little traffic to provide meaningful data from which to determine a traffic speed and/or a new sampling time period. Accordingly, if the number of transactions per antenna does not meet a minimum, the method 200 may terminate. The minimum number of transactions may be set depending on the application and the roadway. In one embodiment, the minimum number is two.

In step 208, the average handshake count per transponder is calculated. In the present embodiment, the average handshake count is determined using only the antenna having the highest number of transactions. This is done so as to ensure the sampling time is set to reflect the vehicle speeds in the fastest lane of traffic. In some embodiments, the handshake count average may be calculated across all the antennas, such than an average handshake count per transponder on the roadway is obtained. In some embodiments, the counting of handshakes and/or the calculation of average handshake count is performed using only the antennas centered in the laneways, and not the antennas positioned between laneways, as these positional differences may impact how an average handshake count correlates to traffic speed.

Once an average handshake count per transponder is determined in step 208, then in step 210 a new sampling time period is calculated. The calculation of a new sampling time period may be based upon a predetermined formula. In another embodiment, the reader consults a lookup table of stored sampling time periods indexed by average handshake count. In one embodiment, for example, the new sampling time period may be given by the formula:

$$TP_{new}=HS_{avg}\times k$$

wherein $TP_{new}$ is the new sampling time period, $HS_{avg}$ is the average handshake count per transponder (which may be based upon the antenna having the highest count, may be averaged across all antennae, may be averaged using only the mid-lane antennae, etc.), and k is a constant related to system implementation and design. It will be appreciated that another formula may be used and that the precise formula will depend upon the size of the coverage zones, the usual speed of the roadway, the number of antennas in an interrogation cycle, and the target point or axis within the coverage zone by which a lane determination is to be made, among other factors.

Those skilled in the art will appreciate that vehicle speed is directly correlated with handshake count for a given captures zone size and interrogation frequency (frame time). Accordingly, the handshake count acts as a proxy for vehicle speed.

In step 212, the reader evaluates whether the newly calculated sampling time period is sufficiently different to justify changing the previous sampling time period. In some embodiments, the newly calculated sampling time period may need to be different by a predetermined amount before the reader will establish it as the current sampling time period. For example, in one embodiment, the reader evaluates whether the newly calculated sampling time period varies from the previous sampling time period by more than 20 percent of the previous sampling time period. If there is a 20 percent variation or greater, then in step 214 the new sampling time period is established as the current sampling time period. Otherwise, the reader elects to continue with the sampling time period unchanged.

It will be appreciated that in some embodiments handshake counts may be accumulated on a per transponder basis—i.e. the reader may associate a handshake count with a particular transponder. In such an embodiment, when a response signal is received from a transponder, the handshake count for the particular transponder is incremented.

It will be appreciated that if separate handshake counts are maintained for each transponder, then the calculation of an average handshake count in step 208 is slightly different in that the individual handshake counts are to be first totaled and then divided by the number of transponders/transactions. It will also be understood that this averaging may be done on an antenna-specific basis or across all antennas of the roadway.

Figure 8:
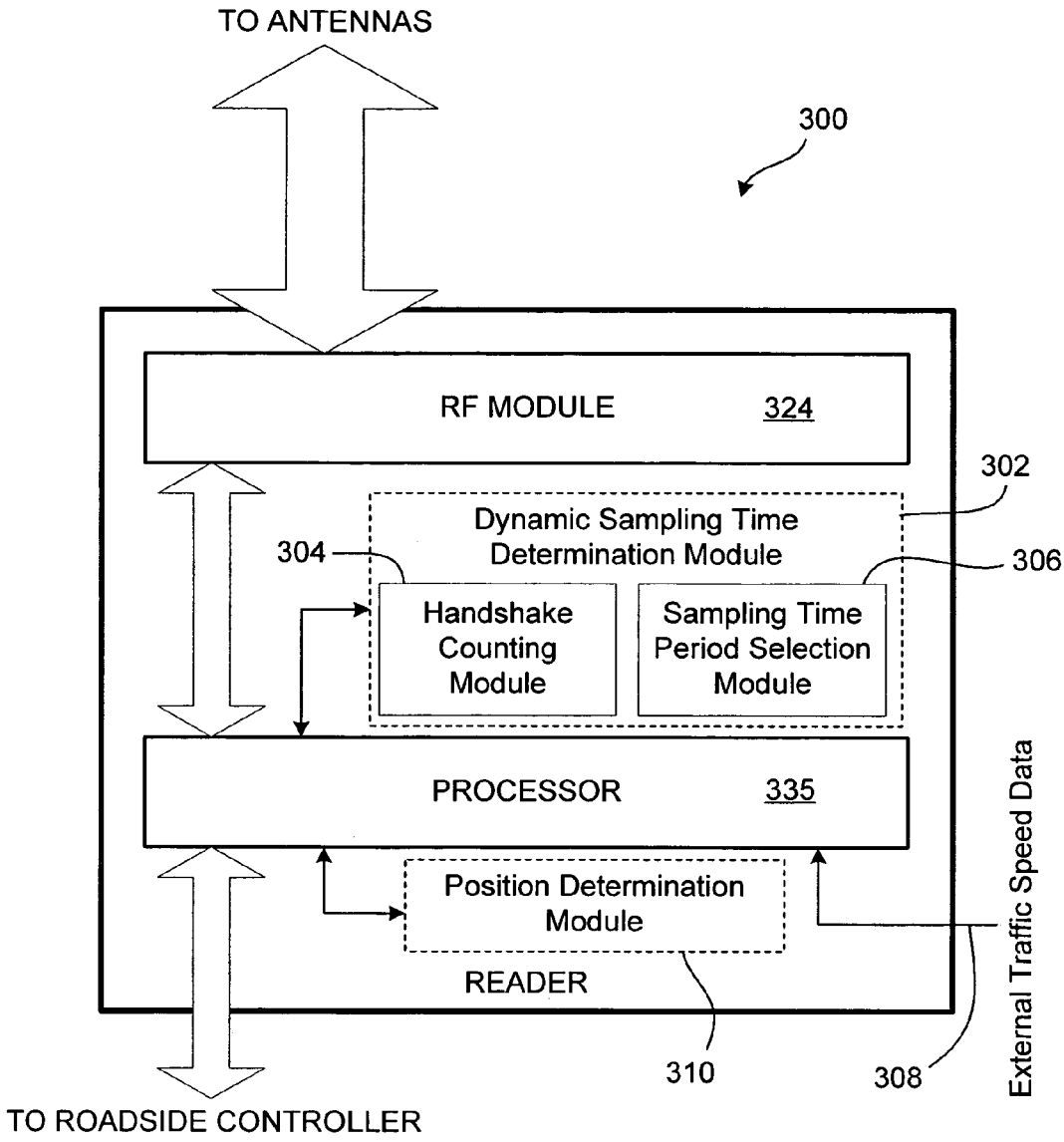
FIG. 8 shows a block diagram of an embodiment of a reader for determining vehicle position.

Reference is now made to FIG. 8, which shows, in block diagram form, a reader 300 for implementing dynamic sampling time period determination. The reader 300 includes an RF module 324 and processor 335, as described in connection with the reader 17 shown in FIG. 1. A position determination module 310 implements the lane assignment process described above. It will be appreciated that the position determination module 310 may be embodied as stored program instructions for configuring the processor 335 to perform functions like initiating an interrogation cycle, counting response signals, and determining position based upon counted response signals.

The reader 300 further includes a dynamic sampling time determination module 302, which includes a handshake count module 304 and a sampling time period selection module 306. The handshake count module 304 counts the handshakes per antenna or per transponder over the course of a test period. It may further include a timer for timing the test period.

The sampling time period selection module 306 selects a new sampling time period based upon the handshake count from the handshake count module 304. For example, the sampling time period selection module 306 may calculate an average handshake count per transponder based upon handshake counts obtained from the handshake count module 304. It may then calculate or look-up a corresponding sampling time period based upon the average handshake count per transponder. It will be appreciated that the average handshake count per transponder is related to the traffic speed on the roadway for a given interrogation cycle time.

In another embodiment, the reader 300 includes an input for receiving external traffic speed data 308. In such an embodiment, the dynamic sampling time determination module 302 and, in particular, the sampling time period selection module 306 may calculate or look-up a sampling time period based upon the external traffic speed data 308.

The dynamic sampling time determination module 302 sets the current sampling time period for the use of the reader 300 in performing lane assignment determination.

Reference is now again made to FIG. 1. The embodiment of an ETC system shown in FIG. 1 includes an enforcement system, specifically the vehicle imaging system 34. As described above, in one embodiment the vehicle imaging system 34 may be triggered to operate on the basis of a vehicle detector 40 detecting the presence of a vehicle in the roadway 12. In some embodiments, the vehicle imaging system 34 may also, or alternatively, be triggered on the basis of an expected travel time from a detection point, like detection line 44, to the camera line 38. The expected travel time is based upon an expected vehicle speed and the distance between the two lines. In one embodiment, the expected travel time is dynamically adjusted on the basis of prevailing roadway traffic speed.

As described above in connection with vehicle position detection, the roadway traffic speed may be obtained through external systems or information suppliers (like a local transportation authority), or based upon its correlation with other variables, like average handshake count within the communication zone. A dynamic timing module adjusts the expected travel time based upon the roadway speed and thereby adjusts the timing for operating the cameras 36.

Figure 9:
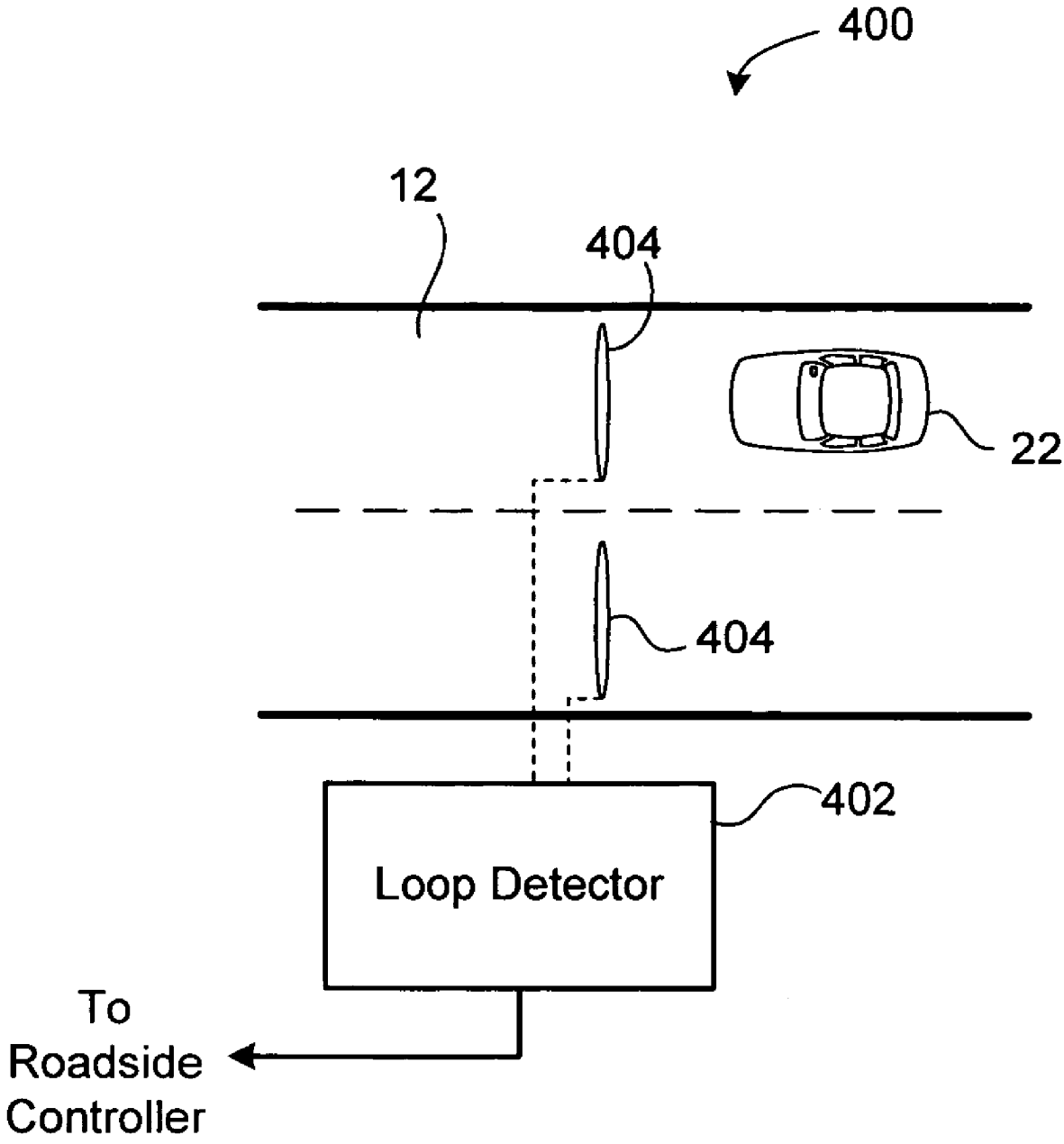
FIG. 9, shows a plan view and block diagram of an embodiment of an in-ground loop detection system in a two-lane open-road application.

Reference is now made to FIG. 9, which shows a plan view of an embodiment of an in-ground loop detector system 400 for counting the axles on a vehicle 22 in an ETC system. The in-ground loop detector system 400 includes in-ground loop antennas 404 within the roadway 12 for establishing an electromagnetic field, and a loop detector 402 for energizing the antennas 404 and detecting the passage of axles based upon the disturbance sensed in the electromagnetic field(s).

The loop detector system 400 may be used within an ETC system to established a class of vehicle entering a toll collection point, since different toll amounts may be charged to vehicles depending upon their classification. For example, a two-axle passenger vehicle may be assessed a lower toll than a four or five-axle transport truck. The determination of whether a detected axle is associated with a first vehicle or whether it marks the first axle of the next vehicle may be made based upon the timing between axle detections. If a certain vehicle speed is assumed, and if a minimum spacing between vehicles may be assumed, the loop detector system 400 may determine for each detected axle whether it is associated with a current vehicle or a next vehicle. The determination may be sent to the roadside controller or other portion of the ETC system for use in processing a toll transaction.

The determination of axle association based upon timing is prone to errors when the assumed vehicle speed changes. If the vehicles travel more slowly, for example due to a traffic jam, then the timing assumptions are undermined and the system 400 will produce incorrect determinations.

Accordingly, the timing value may be dynamically adjusted to account for roadway traffic speed, as described above. The loop detector 402 may receive roadway traffic speed data and may include a dynamic timing module for adjusting a timing value. Alternatively, another portion of the ETC system may provide the loop detector 402 with a dynamically adjusted timing value as the roadway traffic speed changes.

It will also be appreciated that in some embodiments, the loop detector system 400 may be used to detect vehicle speed based upon detected vehicles and/or vehicle axles. The detections made by the loop detector system 400 may assist in providing dynamic timing adjustment to other sub-systems of the ETC system.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A vehicle position determination system for determining a position of a moving vehicle having a transponder in a multi-lane roadway, comprising:

two or more antennas having partially overlapped coverage areas, each for transmitting an interrogation signal and receiving a response signal from the transponder;

a reader for receiving said response signals from said antennas, said reader including a position determination module for determining the position of the moving vehicle based upon said response signals received by said two or more antennas, wherein said determination is made on expiry of a time period, and a dynamic timing module for determining a current traffic speed associated with the multi-lane roadway and for setting said time period based upon said current traffic speed, wherein said current traffic speed comprises a variable correlated to traffic speed, said dynamic timing module measures said variable correlated to traffic speed, and said variable correlated to traffic speed comprises an average number of response signals per transponder while in said coverage areas.

2. The vehicle position determination system claimed in claim 1, wherein said dynamic timing module includes a handshake counting module for counting response signals from each transponder entering said coverage areas over an estimation period and a time period selection module for calculating said average number of response signals per transponder and selecting said time period.

3. The vehicle position determination system claimed in claim 2, wherein said time period selection module calculates said average number of response signals per transponder on a per antenna basis.

4. The vehicle position determination system claimed in claim 3, wherein said antennas include at least two lane-centred antennas and at least one between-lane antenna, and wherein said time period selection module calculates said average with respect to said lane-centred antennas.

5. The vehicle position determination system claimed in claim 3, wherein said reader further includes a component for counting transactions per antenna over said estimation period, and wherein said time period selection module selects said time period based upon said average number of response signals per transponder calculated with respect to an antenna associated with the highest number of transactions.

6. The vehicle position determination system claimed in claim 1, wherein said dynamic timing module sets said time period based upon said average number of response signals.

7. The vehicle position determination system claimed in claim 6, wherein said dynamic timing module sets said calculated time period as a current time period for use by said position determination module if said calculated time period differs from a previous time period by more than a threshold amount.

8. The vehicle position determination system claimed in claim 1, wherein dynamic timing module includes an input for receiving measured current traffic speed data from an external source.

9. A method of determining a position of a moving vehicle having a transponder in a multi-lane roadway, the method comprising:

measuring a current traffic speed associated with the multi-lane roadway;

setting a time period based upon said current traffic speed;

exchanging communications with the transponder through two or more antennas having partially overlapped coverage areas, wherein exchanging communications includes transmitting an interrogation signal and receiving a response signal from the transponder; and determining the position of the moving vehicle based upon said response signals received by said two or more antennas, wherein said determination is made on expiry of the time period, wherein said current traffic speed comprises a variable correlated to traffic speed, measuring the current traffic speed comprises measuring said variable correlated to traffic speed, and said variable correlated to traffic speed comprises an average number of response signals per transponder while in said coverage areas.

10. The method claimed in claim 9, wherein measuring the current traffic speed includes counting response signals from each transponder entering said coverage areas over an estimation period and determining said average number of response signals per transponder.

11. The method claimed in claim 10, wherein determining said average number of response signals includes calculating said average number of response signals per transponder on a per antenna basis.

12. The method claimed in claim 11, wherein said antennas include at least two lane-centred antennas and at least one between-lane antenna, and wherein calculating said average number of responses is performed only with respect to said lane-centred antennas.

13. The method claimed in claim 11, further including counting transactions per antenna over said estimation period, and wherein setting said time period is based upon said average number of response signals per transponder calculated with respect to an antenna associated with the highest number of transactions.

14. The method claimed in claim 9, wherein setting said time period includes calculating said time period based upon said average number of response signals.

15. The method claimed in claim 14, wherein setting said time period further includes setting said calculated time period as a current time period for use in determining if said calculated time period differs from a previous time period by more than a threshold amount.

16. The method claimed in claim 9, wherein measuring said current traffic speed includes receiving measured current traffic speed data from an external source.

17. An electronic toll collection system for conducting transactions with a moving vehicle having a transponder travelling on a roadway, the electronic toll collection system comprising:

at least one subsystem having a trigger component for triggering operation of the subsystem based upon a time period; and a dynamic timing module for determining a current traffic speed associated with the roadway and for setting said time period based upon said current traffic speed, wherein said current traffic speed comprises a variable correlated to traffic speed, said dynamic timing module measures said variable correlated to traffic speed, and said variable correlated to traffic speed comprises an average number of response signals per transponder while in an antenna coverage area.

18. The electronic toll collection system claimed in claim 17, wherein said subsystem comprises a vehicle position determination system including two or more antennas having partially overlapped coverage areas, each for transmitting an interrogation signal and receiving a response signal from the transponder; and a reader for receiving said response signals from said antennas, said reader including a position determination module for determining the position of the moving vehicle based upon said response signals received by said two or more antennas, wherein said determination is made on expiry of said time period.

19. The electronic toll collection system claimed in claim 17, wherein said dynamic timing module includes a handshake counting module for counting response signals from each transponder entering said coverage area over an estimation period and a time period selection module for calculating said average number of response signals per transponder and selecting said time period.

20. The electronic toll collection system claimed in claim 17, wherein dynamic timing module includes an input for receiving measured current traffic speed data from an external source.

21. The electronic toll collection system claimed in claim 17, wherein said subsystem comprises a loop detection system having at least one in-ground loop antenna and a loop detector for counting the number of axles on the moving vehicle and determining a vehicle class, and wherein said determination is based, at least in part, upon whether said time period elapses between the detection of axles.

22. The electronic toll collection system claimed in claim 17, wherein said subsystem comprises an enforcement system including at least one camera for capturing an image of the moving vehicle, and wherein said image is captured on expiry of said time period.

23. A method of dynamically adjusting timing within an electronic toll collection system for conducting transactions with a moving vehicle having a transponder travelling in a roadway, the method comprising:

measuring a current traffic speed associated with the roadway, wherein said current traffic speed comprises a variable correlated to traffic speed, measuring said current traffic speed comprises measuring said variable correlated to traffic speed, and said variable correlated to traffic speed comprises an average number of response signals per transponder while in a coverage area;

setting a time period based upon said current traffic speed, wherein setting said time period includes calculating said time period based upon said average number of response signals; and triggering operation of a subsystem of the electronic toll collection system upon expiry of said time period.

24. The method claimed in claim 23, wherein said subsystem includes a vehicle position determination system, wherein said method further includes exchanging communications with the transponder through two or more antennas having partially overlapped coverage areas, wherein exchanging communications includes transmitting an interrogation signal and receiving a response signal from the transponder, and wherein triggering operation of the subsystem includes determining the position of the moving vehicle based upon said response signals received by said two or more antennas, wherein said determination is made on expiry of the time period.

25. The method claimed in claim 23, wherein measuring said current traffic speed includes receiving measured current traffic speed data from an external source.

26. The method claimed in claim 23, wherein said subsystem includes an enforcement camera for capturing an image of the moving vehicle, and wherein triggering operation of said subsystem includes capturing said image with said enforcement camera.

27. The method claimed in claim 23, wherein said subsystem includes a loop detection system, wherein the method includes counting the number of axles on the moving vehicle and determining a vehicle class based at least in part upon whether said time period expires between detection of axles.

* * * * *